United States Patent [19]

Lagen et al.

[11] Patent Number: 5,002,465

[45] Date of Patent: Mar. 26, 1991

[54] OFF-ON CONTROL FOR AN INFLATION ASPIRATOR

[75] Inventors: Valerie H. Lagen; Steven P. Nagode; Richard B. Dustman, all of Mukilteo, Wash.

[73] Assignee: The Boeing Company, Seattle, Wash.

[21] Appl. No.: 420,582

[22] Filed: Oct. 12, 1989

[51] Int. Cl.[5] ..... F04F 5/48

[52] U.S. Cl. ..... 417/182; 417/181

[58] Field of Search ..... 417/181, 182, 184, 183, 417/190, 191

[56] References Cited

U.S. PATENT DOCUMENTS

| | | | |
|---|---|---|---|
| Re. 27,860 | 1/1974 | Day | 417/184 |
| 3,460,746 | 8/1969 | Green et al. | 417/179 |
| 3,460,747 | 8/1969 | Green et al. | 417/191 |
| 3,640,645 | 8/1969 | Forsythe | 417/184 |
| 3,684,404 | 8/1972 | Galbraith | 417/184 |
| 4,566,872 | 1/1986 | Halavais | 417/189 |

*Primary Examiner*—Leonard E. Smith

*Assistant Examiner*—Robert N. Blackmon

*Attorney, Agent, or Firm*—Delbert J. Barnard

[57] ABSTRACT

In an aspirator (10) for pumping air into an inflatable (16), initial delivery of an aspirating fluid extends a piston (68) and the piston (68) extends an aspirator tube (24) to open an ambient air inlet (30) and render the aspirator (10) operable. Aspirating fluid pressure acts on a valve plug (112) and moves it into a first position in which the aspirating fluid pressure is connected to the linear fluid motor (66) for extending the piston (68). When inflation is substantially completed, back pressure from the inflatable (16) acts on a movable wall (74) which is connected to the valve plug (112) to produce a force which overrides the force of the aspirating fluid pressure acting on the valve plug (112). The overriding force moves the valve plug (112) into a second position in which flow of aspirating fluid into the linear motor (66) is blocked and the piston (68) is vented. A spring (48) then retracts the aspirator tube (24) closing the ambient air inlet (30), and disabling the aspirator (10).

18 Claims, 6 Drawing Sheets

106
78'
74
38
54
56
12
58
34
36
60
62
40
26
64
68
28
46
44
30
102
16
18
28'
14
42
32
42
22
66
42
46
20
52
24
10
70
48
50
72

OFF-ON CONTROL FOR AN INFLATION ASPIRATOR

TECHNICAL FIELD

The present invention relates to aspirators for use in the inflation of gas confining inflatables, such as aircraft escape slides, inflatable life rafts, and the like. More particularly, it relates to the provision of an aspirator which opens and becomes operative in response to the delivery of a pressurized pumping or aspirating fluid to the aspirator and closes and becomes inoperative in response to the ratio of aspirating gas pressure to back pressure in the inflatable reaching a condition short of a "stall" condition.

BACKGROUND ART

A rapid inflation rate is a requirement of many inflatable devices, particularly those used in an emergency, such as aircraft escape slides and inflatable rafts. In a typical inflation system a pressurized aspirating or pumping fluid is introduced as a high velocity stream or streams into a venturi nozzle adapted to discharge into the inflatable. The upstream end of the nozzle is open to the surrounding air during inflation and the high velocity gas stream, or streams, creates a suction to draw or aspirate ambient air into the stream or streams for increasing its or their volume. When the inflatable is substantially inflated, it is common practice to shut off or disable the aspirator and complete the inflation by use of the aspirating fluid alone.

A known aspirator includes an aspirator tube which is movable in and out relative to a housing that is fixed to the inflatable and mounts a group of jet tubes which convert the pressurized pumping fluid into high velocity jet streams. At the start of inflation the tube is extended into the inflatable to open an ambient air inlet at its outer end. Near the completion of inflation the aspirator tube is retracted out from the inflatable and its outer end functions as a closure for the ambient air inlet. Inflation is completed by the pressurized fluid alone. Such a prior art aspirator is shown by FIGS. 1 and 2. This type of aspirator includes a linear fluid motor that is connected to the aspirator tube by a connector rod. At the start of inflation some of the aspirating fluid pressure is directed into the linear fluid motor for moving the rod to extend the aspirator tube. A normally opened spool valve is provided in a passageway for delivering aspirating fluid pressure into the linear fluid motor. This valve is normally biased into an open position by a compression spring which is on one side of a movable wall. The opposite side of the movable wall is in communication with back pressure from the inflatable. When back pressure is developed this back pressure is imposed on the movable wall to produce a force in opposition the spring force. Near the completion of inflation the back pressure acting on the movable wall creates a force sufficient to overcome the force of the spring. When this happens the movable wall moves and repositions the valve spool to block flow of aspirating fluid into the linear fluid motor and at the same time vent the linear fluid motor. In response, a spring acts to retract the aspirator tube and close the ambient air inlet. A major disadvantage of this type of system is that the aspirator can only be set for a single pressure value, viz. a pressure sufficient to overcome the force of the biasing spring acting on the valve spool. An aspirator is required to operate over a large range of environmental conditions which have a direct effect on both pressure of the aspirating fluid at the inlet and back pressure in the inflatable. An aspirator set to close the ambient air inlet at a single pressure value is simply inadequate.

U.S. Pat. No. RE 27,860, granted Jan. 1, 1974, to Ronald H. Day, discloses an aspirator which operates in essentially the same way as the "prior art" aspirator shown by FIGS. 1 and 2 of the drawing. The aspirator tube retracts to close the ambient air inlet when the back pressure reaches a predetermined value and produces a force sufficient to overcome a spring force which biases the control valve into a first position.

U.S. Pat. No. 4,566,862, granted Jan. 28, 1986, to Richard A. Halavais, discloses an inflation system comprising a container of pressurized gas, a regulator for regulating the pressure of the gas as it leaves the container, a controller and an aspirator or ejector. The controller monitors the dynamic pressure within the aspirator and the static pressure within the inflatable to provide a feed back to the regulator. The objective is to provide a constant total mass flow through the aspirator at all times throughout the inflation cycle.

Other known inflation aspirators existing in the patent literature are shown by U.S. Pat. No. 3,460,746, granted Aug. 12, 1969, to Charles J. Green et al, by U.S. Pat. No. 3,460,747, granted Aug. 12, 1969, to Charles. J. Green et al, by U.S. Pat. No. 3,640,645, granted Feb. 8, 1972 to Alan K. Forsythe, and by U.S. Pat. No. 3,684,404 granted Aug. 15, 1972 to Lyle D. Galbraith.

A principal object of the present invention is to provide an improved inflation aspirator of the type having an aspirator tube which is retracted to close the ambient air inlet of the aspirator to, disable the aspirator, characterized by an improved control mechanism which causes such retraction to occur when the ratio of aspirating fluid pressure to back pressure approaches but has not yet reached a stall condition.

DESCRIPTION OF THE INVENTION

Aspirators embodying the present invention are basically characterized by a valve plug in the delivery path of aspirating fluid to the linear fluid motor which extends the aspirator tube. Upon the delivery of aspirating fluid to the aspirator, to start inflation, the pressure of this fluid acts on the valve plug and moves it into a position communicating such fluid pressure with the linear fluid motor. The fluid motor responds by extending the aspirator tube, to open the ambient air inlet of the aspirator. According to the invention, a connector rod extends from the valve plug to and through an end wall of a chamber in which the valve plug is situated and moves. The end of the connector rod opposite the valve plug is connectable to a movable wall. The rod side the movable wall is in communication with the interior of the inflatable so that the back pressure is exerted on this side of the movable wall. The opposite side of the movable wall is vented to atmospheric pressure. In preferred form, the pressure of the aspirating fluid acting on the valve plug produces a force on the valve plug in opposition to a biasing spring. This force overrides the spring force and moves the valve plug into a position communicating the aspirating fluid pressure with the base of the piston in the linear fluid motor. The biasing spring and back pressure acting on the movable wall together produce a force acting on the valve plug in the opposite direction. The spring force and the area relationship of the valve plug to the movable wall are chosen such that the combined force of the biasing spring and the force created by the back pressure acting on the movable wall will, in response to the back pressure in the inflatable reaching a predetermined level below a stall condition, shift the valve plug in position to block delivery of aspirating fluid pressure with the base of the piston and at the same time communicate the base of the piston with a vent passageway. The venting of the base end of the piston permits retraction of the piston, and hence a retraction of the aspirator tube to close the ambient air inlet of the aspirator, to in that manner disable the aspirator. Typically, a spring is used for retracting the aspirator tube.

Other objects, advantages and features of the invention are herein after described as a part of the description of the best mode of the invention.

BRIEF DESCRIPTION OF THE DRAWING

In the drawing like element designations refer to like parts throughout the several views, and.

DESCRIPTION OF THE BEST MODE

Figure 1:
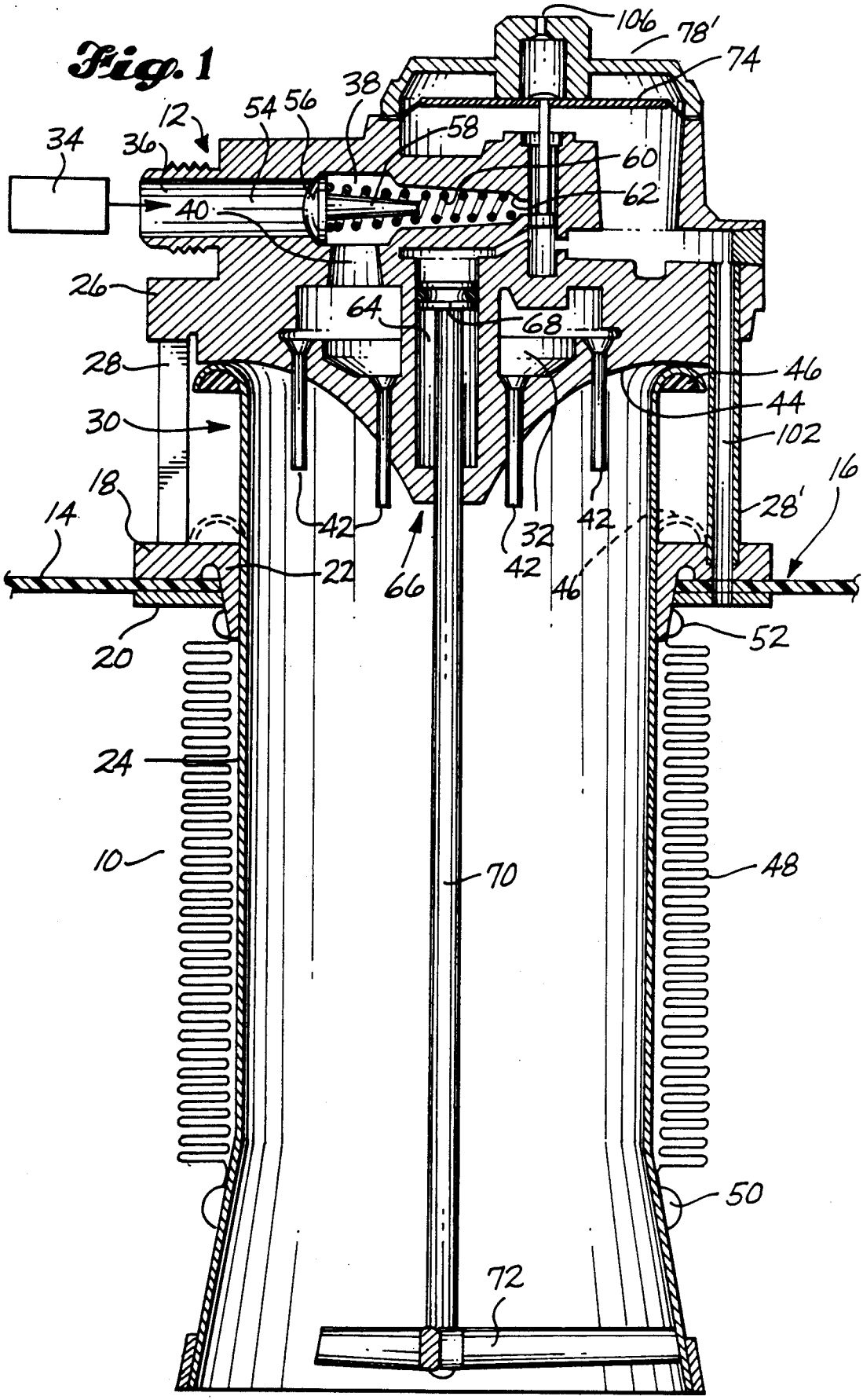
FIG. 1 is an axial sectional view of an aspirator which incorporates an embodiment of the invention, such view showing the aspirator in a disabled position with both the pressure fluid inlet and the ambient air inlet closed.
Figure 2:
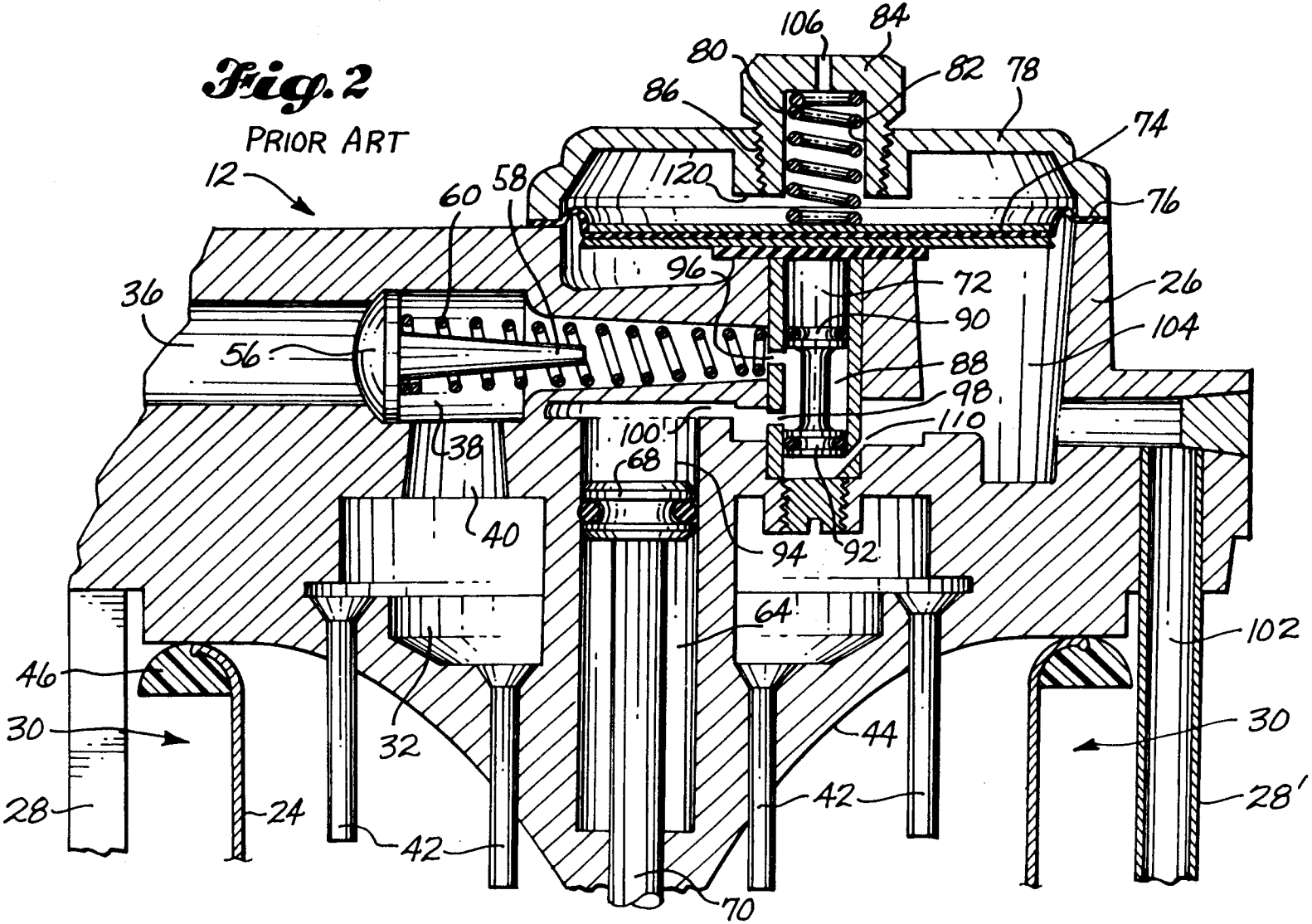
Fig. 2 PRIOR ART
FIG. 2 is an enlarged scale axial sectional view of a prior control valve for delivering pressure to the piston of a linear fluid motor which opens the aspirator inlet, such view also showing the aspirator in a disabled position with the aspirator inlet closed.
Figure 3:
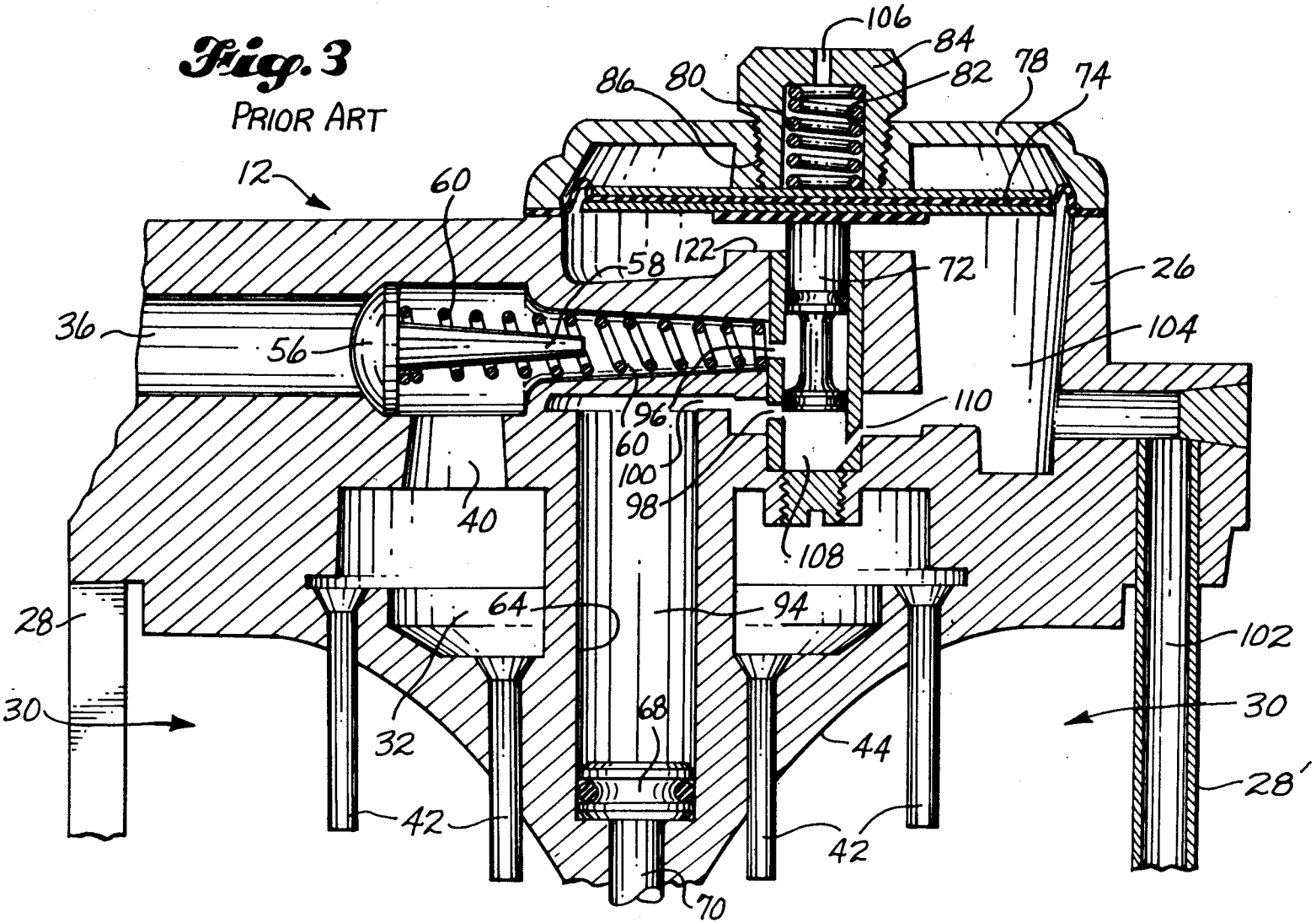
Fig. 3 PRIOR ART
FIG. 3 is a view like FIG. 2, but showing as aspirating fluid being delivered into the aspirator and further showing the piston of the linear motor in an extended position and the ambient air inlet of the aspirator in an open position.

FIG. 1 illustrates an embodiment of the invention. This embodiment is like a prior art aspirator except for the mechanism which controls the delivery of fluid pressure to and from the linear fluid motor which extends the aspirator tube. FIGS. 2 and 3 show a prior art control mechanism in the same aspirator. FIGS. 4–7 show embodiments of the invention.

Referring first to FIG. 1, the aspirator 10 comprises an outboard housing 12 which is attached to a wall portion 14 of an inflatable 16, at the inlet for the inflatable 16. Housing 12 includes a base portion 18 which is positioned on the outside on the wall 14. It is secured to an annular collar 20 which is positioned on the inside of wall 14, such as by the use of screw fasteners, as disclosed by the aforementioned U.S. Pat. Nos. 3,684,404 and RE 27860.

Base 18 includes a tubular portion 22 for guiding an elongated tube 24 which will herein be referred to as the "aspirator tube." Housing 12 also concludes a head portion 26 which is spaced outwardly from the base portion 18. A circular array of spacer bars or members 28 extend between and interconnect the head and base portions 16, 18. A circular array of inlet openings are defined by and between the connector members 28. This construction is as clearly shown by FIG. 1 of the aforementioned U.S. Pat. 3,684,404. These openings together define an ambient air inlet 30 which is annular except where it is interrupted by the connectors 28.

Head portion 26 includes a high pressure fluid chamber or manifold 32. A source 34 of high pressure fluid is connected to an inlet passageway 36 which leads to a valve chamber 38. A passageway 40 connects the valve chamber 38 with manifold 32. A plurality of jet nozzles 42 extend from chamber 32 axially of the aspirator tube 24. The end wall 44 of head portion 26 is somewhat conical in form and is of concave curvature in the axial direction. Surface 44 functions to redirect the ambient air which enters inlet 30 from a substantially radial flow into an axial flow through the aspirator tube 24.

The outer end of aspirator tube 24 may include an annular seal ring 46 constructed from an elastomeric material, as illustrated. Or, the outer end of aspirator tube 24 may be in the form of an annular flange which contacts an elastomeric seal ring carried by head portion 26, in the matter disclosed by the aforementioned U.S. Pat. No. RE 27,860.

FIG. 1 shows aspirator tube 24 in a retracted position with its outer end in sealing engagement with a confronting surface portion of head member 26. In the same matter as shown the aforementioned U.S. Pat. No. RE 27,868, an accordian-like spring member 48 may be secured at one end 50 to an inner end portion of aspirator tube 24 and at its opposite end 52 to base portion 18. This spring 48 normally biases the aspirator tube 24 into a retracted position in which the outer end portion of tube 24 closes the ambient air inlet 30. This position is shown in solid line in FIG. 1. The extended position of the outer end of aspirator tube 24 is shown in broken line in FIG. 1. When aspirator tube 24 is extended ambient air may enter into the inlet 30, between the spacer members 28, and between guide wall 44 and the outer end surface of member 46.

A poppet valve member 54 is located within the valve chamber 38. It includes a valve plug 56 and a stem 58. One end of a compression spring 60 abuts against the valve plug 56, about its connection to the stem 58. The opposite end of spring 60 is received in a passageway 62 which is in axial alignment with inlet passageway 36. The spring 60 normally biases the valve plug 56 into a closed position.

In operation of the aspirator, to the extent that it has so far been described, a pressurized aspirating or pumping fluid is delivered from the source 34 into the inlet passageway 36. The fluid pressure acts against valve plug 56 and moves the valve plug axially in opposition to the force of spring 60. Most of the fluid then flows through passageway 40 into manifold 32 and from manifold 32 into and through the nozzles 42. The nozzles 42 convert the pressure fluid into high velocity jets and it is these jets which pump or aspirate ambient air into the ambient air inlet 30 and then through the aspirator tube 24 into the inflatable 16. The spring 48, or a substituted equivalent structure, biases the aspirator tube 24 into a retracted position in which it closes the ambient air inlet 30.

In a manner to be hereinafter described, some of the pressure fluid delivered into the inlet passageway 36 is directed into a piston chamber 64 of a linear fluid motor 66, at the base end of a piston 68. This fluid pressure is exerted against the piston 68, causing it to move axially through the piston chamber 64. A connector rod 70 is connected at its outer end to piston 68 and at its inner end to a spider 72 which is connected to an inner end portion of the aspirator tube 24. Thus, extension of the piston 68 causes an extension of both the connector rod 70 and the aspirator tube 24. So long as pressure fluid is within the piston chamber 64, at the base of the piston 68, the aspirator tube 24 is fully extended and the ambient air inlet 30 is open.

As previously mentioned, FIGS. 1 and 4–7 disclose control mechanism of the present invention for controlling fluid pressure into and out from the piston chamber 64. This mechanism will hereinafter be described, but first a prior art control mechanism will be described, with reference to FIGS. 2 and 3 of the drawing.

As will be apparent, the basic aspirator structure shown in FIGS. 2 and 3 is the same as disclosed in FIG. 1. For that reason, only the head portion of the aspirator housing 12 is illustrated in FIGS. 2 and 3. In other words, the portion of the aspirator that is not illustrated in FIGS. 2 and 3 is identical to what is disclosed if FIG. 1. As previously stated, this structure is essentially prior art structure.

Referring to FIGS. 2 and 3, the prior art control comprises a valve spool 74 which is connected at its outer end to a movable wall 74. Movable wall 74 is in the nature of a diaphragm having a peripheral edge portion 76 which is clamped between head portion 26 of body 12 and end cap 78. A compression spring 80 is positioned on the side of wall 74 opposite the valve spool 78. Spring 80 normally biases the valve spool into the position shown by FIG. 2. The end of spring 80 opposite wall 74 is contained within a socket 82 formed in a cup 84. Cup 84 includes threads which engage threads in a central opening in the cap 78 to form a threaded connection 86.

Valve spool 72 includes an annular passageway 88 formed between a pair of spaced apart lands 90, 92. When the valve spool 72 is in the position shown by FIG. 2, and poppet valve 56 is open, allowing fluid pressure into valve chamber 38, this fluid pressure is delivered to region 94 of piston chamber 64 by way of a first port 96 in a wall of the valve plug chamber, the annular passageway 88, a second port 98 in the wall of the valve plug chamber, and a passageway 100. The fluid pressure acts on the piston 68, moving it lengthwise of the piston chamber 64. This extends the connector rod 70 and in turn the aspirator tube 24 to which the connector rod 70 is connected, to in that manner open the ambient air inlet 30. The continuous introduction of pressure fluid into inlet passageway 36 maintains the poppet valve 56 open and results in such pressure fluid first entering the manifold 32 and then flowing out of the manifold 32 through the jet tubes 42. The jets of pressurized fluid flowing out from the tubes 42, axially of the aspirator tube 24, "pumps" a substantial quantity of ambient air into the ambient air inlet 30 and through the aspirator tube 24 into the inflatable 16.

The prior art system shown by FIGS. 2 and 3 includes a tubular connector 28' which provides a back pressure passageway 102 which communicates the interior inflatable 16 with a back pressure chamber 104. As illustrated, back pressure chamber 104 is bounded at its outer end by the movable wall 74. The side of wall 74 opposite the back pressure chamber 104 is vented to the atmosphere, by way of a vent passageway 106 in the end wall of cap 84. Owing to this construction, the only force acting to extend valve plug 92 is the force produced by the spring 80. At times an opposing force is applied to valve spool 72 in the opposite direction. This force is the product of the fluid pressure in back pressure chamber 104 and the area of movable wall 74.

In operation of the prior art device shown by FIGS. 2 and 3, the poppet valve 56 is normally open and the valve spool 72 is normally in an open position, as shown by FIG. 2. When it is desired to inflate the inflatable 16, a pressurized fluid from a source 34 is introduced into the inlet passageway 36. This fluid first acts on valve plug 56, moving it endwise in opposition to the spring 60 into an open position. Following opening of valve plug 56, some of the pressurized fluid flows through port 96, passageway 88, port 98 and passageway 90 into region 94 of piston chamber 64. This pressure acts on piston 68, extending it, the connector rod 70 and the aspirator tube 24, to move the aspirator tube 24 into an operative position and at the same time open the ambient air inlet 30. The remainder of the pressurized fluid flows through passageway 40 into manifold 32 and from manifold 32 out through the jet tubes 42. The fluid issues from the tubes 42 as high velocity jet streams. These streams entrain or pump ambient air into the inlet 30 and then into and through the aspirator tube 24 into the inflatable 16.

As the inflatable 16 fills, a back pressure is developed. This back pressure is communicated by the passageway 102 to the back pressure chamber 104. Near the end of inflation the back pressure in back pressure chamber 104 acting on movable wall 74 will produce a sufficient force in opposition to the force of spring 80 to override the spring 80 and move the valve plug 72 endwise from the position shown by FIG. 2 into the position shown by FIG. 3. When this happens, the land 72 moves into a position above port 98. This communicates piston chamber region 94 with the back pressure chamber 104 via passageway 100, port 98, end region 108 of the valve plug chamber, and a port 110. The pressure in back pressure chamber 104 is substantially lower than the pressure in region 94 of piston chamber 64. As a result, the pressure in region 94 is vented into the back pressure chamber 104 releasing pressure from piston 68. This release of pressure from piston 68 allows the spring 48 to retract the aspirator tube 24 and close the ambient air inlet 30. Inflation of the inflatable 16 is then completed by continuing the introduction of the pressurized fluid into the inflatable 16 through the nozzles 42.

The prior art system shown by FIG. 2 can only be set to close in response to a single back pressure value. The force of spring 80 is a fixed value and the area of movable wall 74 is a fixed value. The spring force is over come when the back pressure within chamber 104 reaches a fixed value. An aspirator is required to operate within a substantial range of environmental conditions which have a direct effect on both inlet and back pressures. For this reason, a control valve which closes in response to a single back pressure value is not suitable for all operating conditions. Testing has shown that choosing one closing pressure either closes the aspirator prematurely, which decreases the efficiency of the unit, or closes the aspirator late which results in reversed flow and reduced inflatable pressure. Also, it may be possible that under some conditions the back pressure required for closing the valve is never developed. In such a case, the unit would stay open until the aspirating fluid pressure can no longer maintain the aspirator in the open position.

The aspirator control of the present invention will now be described with reference first to FIGS. 4 and 5. As previously mentioned, and as shown by FIG. 1, the portion of the aspirator 10 that is not shown by FIGS. 4 and 5 is identical to the prior art aspirator.

Figure 4:
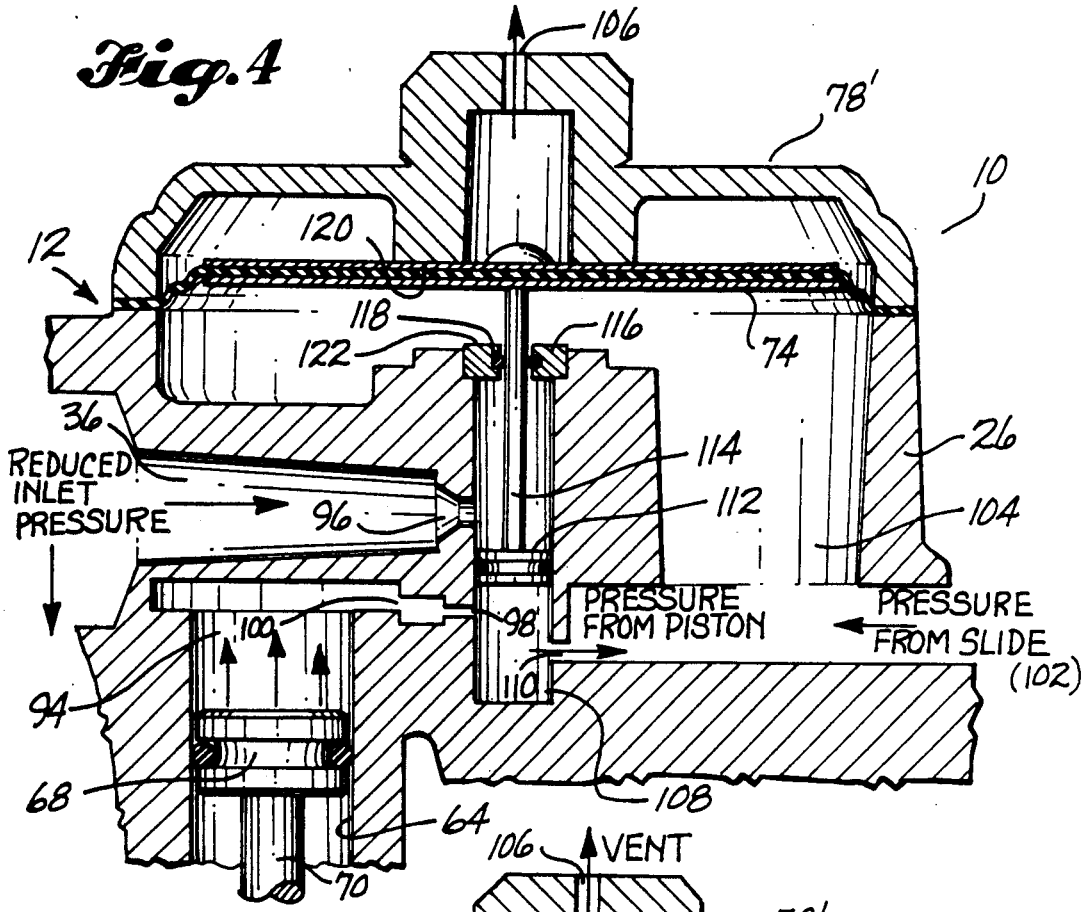
FIG. 4 is a view like FIGS. 2 and 3, but showing a control valve constructed according to the present invention, such view showing the control valve in the position which it occupies when the high pressure aspirating fluid for the aspirator is not being delivered to the aspirator.
Figure 5:
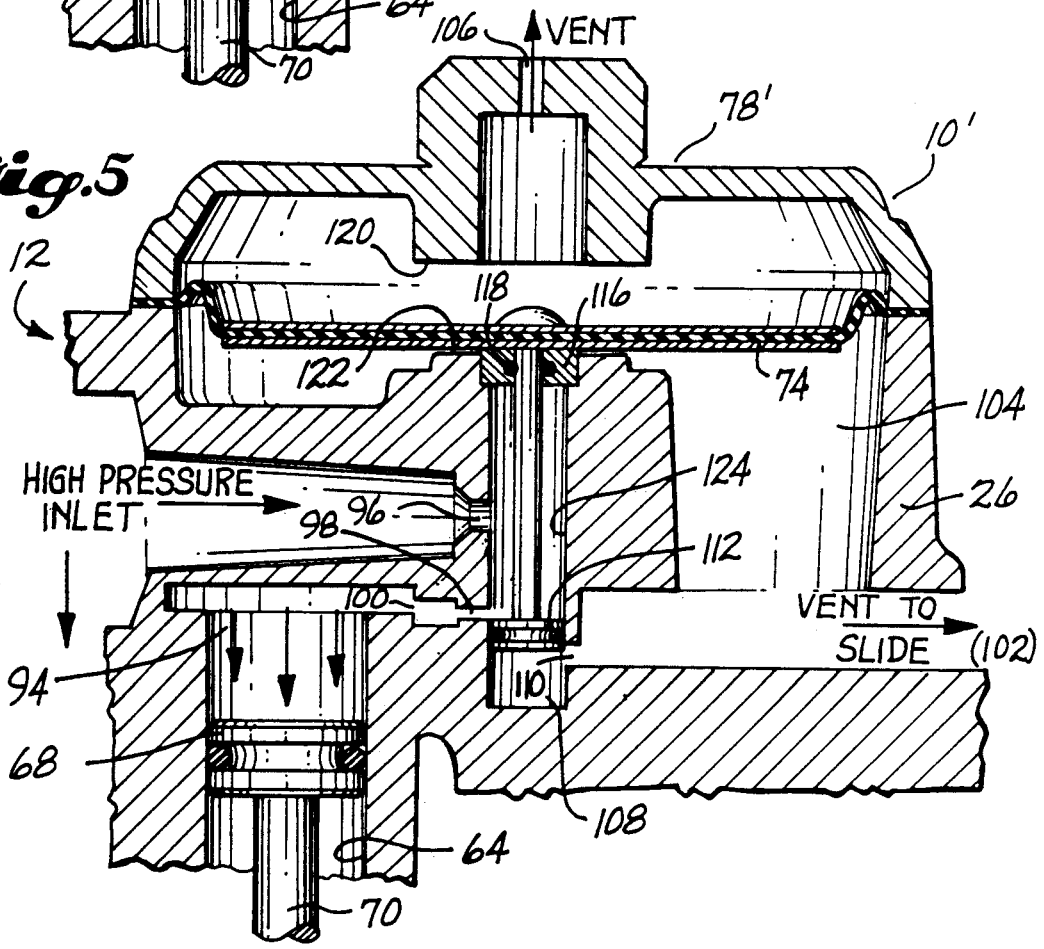
FIG. 5 is a view like FIG. 4, but showing the control valve shifted in position by the delivery of the aspirating fluid to the aspirator.

Referring to FIGS. 4 and 5, in illustrated embodiment, the valve spool 72 in the prior art aspirator is replaced by a valve plug 112, a connector rod 114, a chamber end wall 116 including an opening through which the rod 114 extends, and a seal 118 sealing between such opening and the rod 114, so that pressure fluid will not leak out between the rod and the opening. As shown, one end of the rod 114 is connected to the valve plug 112 and the opposite end of rod 114 is connected to the movable wall 74. The biasing spring 80 that was in the prior art device has been omitted, and the at rest position of the movable wall 74 is now up against an outer stop 120 whereas the at-rest position of movable wall 74 in the prior art device was down against a lower stop 122. As shown by FIG. 4, the at rest position of valve plug 112 places it axially between the side wall ports 96 and 98.

In operation, pressurized fluid from a suitable source is introduced into the inlet passageway 36, as in the prior art aspirator. This pressure fluid opens the poppet valve 56. As in the prior art device, some of the pressure fluid flows to and through the port 96. However, this time it exerts a force on the rod end of the valve plug 112. The force is a product of the fluid pressure and the area of the valve plug 112 in the annular region surrounding rod 114. At this time the pressure within back pressure chamber 104 is low and so no counter force is developed by back pressure acting on area 74 in opposition to the delivered pressure acting on valve 112. As a result, the delivered pressure acting on valve plug 112 moves the valve plug from the position shown by FIG. 4 into the position shown by FIG. 5. In this new position the valve plug 112 is positioned below port 98, allowing the pressure fluid to flow from the valve plug chamber 124 through the port 98 and into the region 94 of piston chamber 64. Within chamber 94 the pressure fluid acts on the piston 68, moving it endwise of the chamber 64 and extending the connector rod 70 and the aspirator tube 24, as in the prior art aspirator. Thus, the ambient air inlet 30 is open and the aspirator 10 is made operable, in essentially the same manner as in the prior art aspirator.

The pressure fluid continues to flow into inlet passageway 36, into the manifold 32 (FIG. 1), and from manifold 32 into and through the jet forming nozzles 44 (FIG. 1). The jet streams pump in ambient air and move it into the inflatable 16. The back pressure developed in the inflatable 16 is communicated via a passageway 102 into the back pressure chamber 104. This pressure is relatively small in comparison to the aspirating fluid pressure being delivered into the aspirator inlet passageway 36. However, it acts on movable wall 74 which is substantially larger in area than the area of valve plug 112. The working area of valve plug 112 and the area of movable wall 74 are chosen so that the force developed by the back pressure acting on wall 74 will override the force produced by the aspirating fluid pressure acting on valve plug 112 at a time when the system is approaching but has not yet reached a "stall" condition. In response, the overriding force acts on valve closure 112 by way of the connector rod 114. The movable wall 74 is moved from the position shown by FIG. 5 into the position shown by FIG. 4 and the valve plug 112 is once again positioned above the port 98. This movement of valve plug 112 causes the region 94 of piston chamber 64 to be vented to the back pressure 104 by way of passageway 98, chamber region 108 and port 110. The fluid pressure acting on the base of piston 68 is thus vented into the back pressure chamber 104, allowing the spring 48 to move the aspirator tube into a retracted position. As in the prior art aspirator, this movement of the aspirator tube 24 closes the ambient air inlet 30. The delivery of fluid into the inlets 36 and manifold 32 is continued and such fluid flows through the nozzles 42 and by itself completes the inflation of the inflatable 16.

Figure 6:
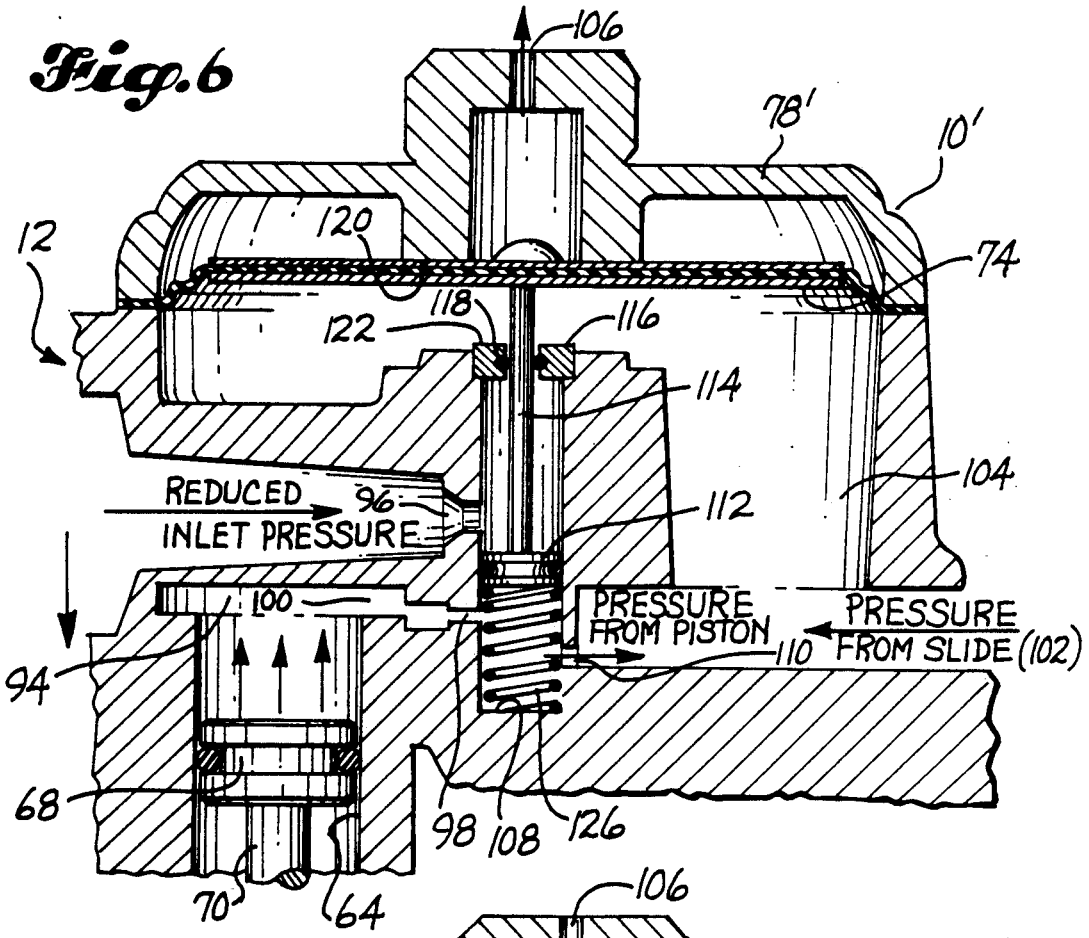
FIG. 6 is a view similar to FIG. 4, but showing a compression spring positioned below the valve plug member.
Figure 7:
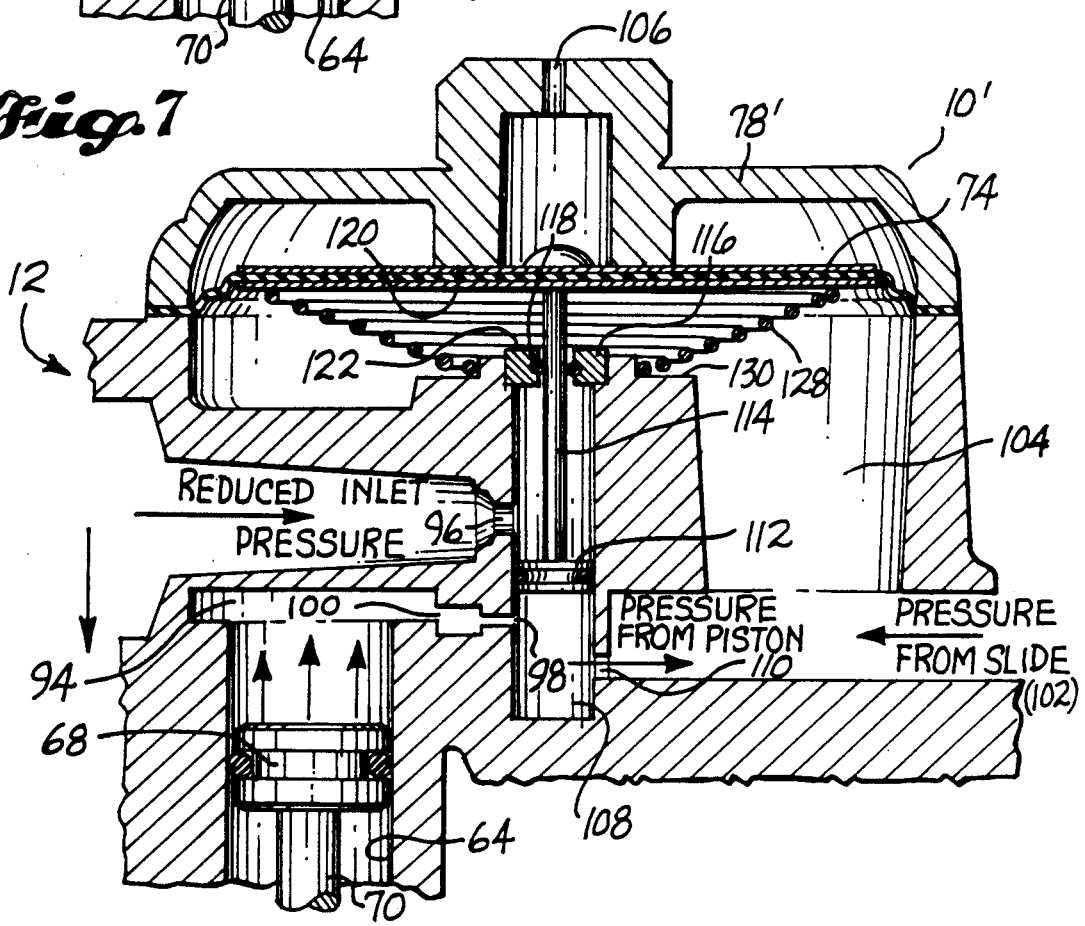
FIG. 7 is a view like FIGS. 4 and 6, but showing a conical compression spring positioned between an end of the valve plug housing and a movable wall which is connected to the upper end of a rod which extends upwardly from the valve plug member.

FIGS. 6 and 7 show two different modified embodiments of the invention. The embodiment of FIG. 6 is identical to the embodiment of FIGS. 4 and 5, except that a biasing spring 126 is positioned within chamber region 108. Spring 126 normally biases valve plug 112 and rod 114 upwardly and movable wall 74 into a position against stop 120. The force created by the aspirating fluid pressure acting on the rod end of valve plug 12 is sufficient to overcome the force of spring 126 at the start of and during most of the inflation process. When a back pressure is being felt in back pressure chamber 104, the spring force and the force produced by the back pressure acting on the area of movable wall 74 together oppose the force of the aspirating fluid acting on the rod side of the closure member 112. In this embodiment, the working surface area of valve plug 112 and the area of movable wall 74 are chosen such that the force produced by the back pressure acting on movable wall 74, in combination with the spring force produced by spring 126, will together override the force produced by the aspirating fluid pressure acting on the rod side of the valve plug 112 at a time when the system is approaching but has not yet reached a "stall" condition.

The embodiment of FIG. 7 is like the embodiment shown by FIGS. 4 and 5 and also like the embodiment shown by FIG. 6, except that a conical biasing spring 128 is employed and it is positioned between a spring abutment 130 and the movable wall 74. The spring abutment 130 may be in the form of an annular shoulder formed in the structure which defines stop 124 and together with insert 116 also defines the outer end of the valve plug chamber. The shoulder 130 defines a reduced diameter boss which is sized to fit into the small end of the spring 128. The opposite larger end of the spring 128 preferably engages the movable wall 74 adjacent the periphery of the wall 74. FIG. 7 shows the spring 128 functioning to urge the movable wall 74 against the stop 120.

As will be apparent from FIG. 7, when aspirating fluid pressure is acting of the valve plug member 112, the force of spring 128 will be overcome and the movable wall 74 will be moved into the position by FIG. 5. The spring 128 will compress sufficiently to allow movable wall 74 to move down into contact with the stop 122. The embodiment of FIG. 7 functions like the embodiment of FIG. 6, but with the biasing spring 128 performing the function of biasing spring 126. The embodiment of FIG. 7 is the preferred embodiment and hence is the best mode of the invention known at this time.

In each embodiment of the invention, the movable wall 74 is shown in the form of a diaphragm that is secured at its outer periphery, in a known manner, between two housing members. In other embodiments, the movable wall may take the form of a piston. Also, as in the prior art device, a sleeve may be fitted into a bore to form the valve plug chamber and the ports 96, 98, 110 may be formed in side wall portions of the sleeve Also, member 116 may be an end portion of the sleeve, or may be a separate member or collar sized to fit into the outer end portion of the sleeve.

Figure 8:
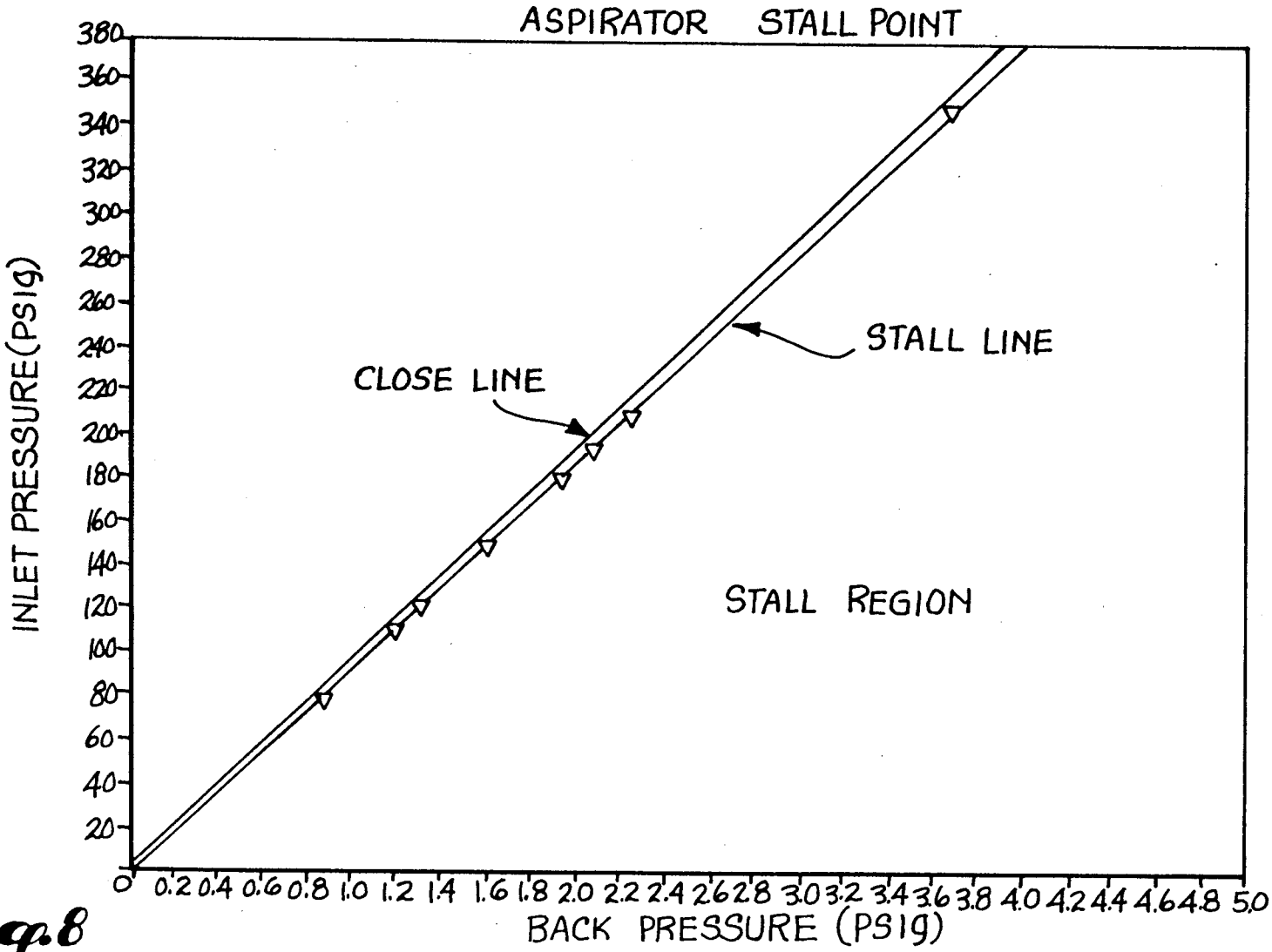
FIG. 8 is a graph plotting aspirating fluid pressure versus back pressure, such graph showing a stall line above which the aspirator will function to pump ambient air into the inflatable and below which the back pressure in the inflatable will override the aspirator and spill air out from the inflatable through the inlet of the aspirator, and also showing a "close line" above the stall line, indicative of the pressure conditions which will trigger the control valve of the present invention to close the aspirator.

FIG. 8 is a plot of aspirating fluid pressure versus back pressure over a wide range of operating conditions. The "stall line" divides the graph into an upper region in which the aspirating fluid pressure is sufficient to aspirate ambient air into the inflatable. The region below the "stall line" is the region in which the back pressure overrides the aspirating fluid pressure and stalls the aspirator, resulting in fluid flow out from the inflatable through the aspirator to the atmosphere. According to the invention, working the area of the valve plug and the area of the movable wall are chosen such that the force of the back pressure acting on the movable wall, either alone or in combination with a biasing spring force, will exceed the force of the aspirating fluid pressure acting on the valve plug member when the aspirator operation is approaching but has not yet reached a stall condition. The two areas and the spring force, if a biasing spring is used, can be chosen so as to cause the aspirator to close on a "close line" above the "stall line", as shown in FIG. 8.

It is to be understood that the illustrated embodiments are presented merely by way of example. The scope of protection is not to be limited by these embodiments, but only by the appended claims, interpreted in accordance with established rules of patent claim interpretation, including use of the doctrine of equivalents.

What is claimed is:

1. For use with a gas confining inflatable, an aspirator of a type including an aspirator tube that is extendable to open an ambient air inlet by delivery of fluid pressure into a linear fluid motor which is connected to the aspirator tube, and is retractable to close said inlet upon removal of fluid pressure from said linear fluid motor, an improved control for delivering fluid pressure to and from said linear fluid motor, comprising:

an elongated valve plug chamber having first and second ends;

a valve plug in said valve plug chamber having upstream and downstream ends;

a back pressure chamber endwise outwardly of the first end of said valve plug chamber;

a moveable wall in said back pressure chamber;

a connector rod extending through said first end of the valve plug chamber and interconnecting the valve plug and the movable wall;

a pressure fluid inlet for said valve plug chamber leading into the valve plug chamber upstream of the valve plug;

a first outlet for the valve plug chamber for communicating the valve plug chamber with the linear fluid motor;

a second outlet for the valve plug chamber for communicating the valve plug chamber with the back pressure chamber;

means for delivering pressure fluid to and through said pressure fluid inlet into the valve plug chamber and against both the first end of said chamber and the upstream end of the valve plug to create a pressure fluid force on the valve plug for moving the valve plug axially through the valve plug chamber into a position downstream of the first outlet and upstream of the second outlet, whereby fluid pressure from the valve plug chamber is delivered through said first outlet into the linear fluid motor for powering the linear fluid motor to extend the aspirator tube;

a passageway communicating the interior of the inflatable with the back pressure chamber, with the back pressure acting on said moveable wall to, when the back pressure reaches a predetermined level, create a back pressure force which overrides the pressure fluid force and moves the moveable wall and the connector rod to in turn move the valve plug into a vent position;

wherein when the valve plug is in said vent position it is between the pressure fluid inlet and the two outlets and the pressure in the linear fluid motor is vented into the back pressure chamber via the first outlet, the valve plug chamber and the second outlet; and wherein such venting permits a retraction of the aspirator tube for closing the ambient air inlet.

2. The improvement of claim 1, further comprising a pair of spaced apart stops, one on each side of the movable wall, between which the movable wall moves, said stops establishing the limits of movement of the movable wall and the valve plug.

3. The improvement of claim 2, further comprising a spring acting on the valve plug, the connector rod and the movable wall, for normally biasing the movable wall against a first said stop and the valve plug into a position between said pressure fluid inlet and said first and second outlets.

4. The improvement of claim 3, wherein said spring is a compression spring positioned within the valve plug chamber, between the second end of the chamber and the valve plug.

5. The improvement of claim 3, wherein the spring is a compression spring positioned between the first end of the valve plug chamber and the movable wall.

6. The improvement of claim 5, wherein the spring is a conical compression spring having a small first end positioned against the first end of the valve plug chamber and a large second end positioned against the movable wall.

7. The improvement of claim 1, wherein the side of the movable wall opposite the connector rod is vented to atmosphere.

8. The improvement of claim 1, further comprising a spring acting on the valve plug, the connector rod and the movable wall, for normally biasing the valve plug into a position between the pressure fluid inlet and the second end of the valve plug chamber, and wherein in such position the valve plug blocks communication of the pressure fluid inlet with the first and second outlets.

9. The improvement of claim 8, wherein the spring is a compression spring positioned between the first end of the valve plug chamber and the movable wall.

10. The improvement of claim 9, wherein the spring is a conical compression spring having a small first end positioned against the first end of the valve plug chamber and a large second end positioned against the movable wall.

11. The improvement of claim 8, wherein the area of the movable wall exposed to back pressure in the back pressure chamber is sized in comparison to the area of the valve plug exposed to the pressure fluid in the valve plug chamber such that the back pressure force will override the pressure fluid force and move the valve plug into its vent position before back pressure in the .inflatable is at a sufficient level to stall the aspirator.

12. The improvement of claim 11, wherein the spring is a compression spring positioned between the first end of the valve plug chamber and the movable wall.

13. The improvement of claim 12, wherein the spring is a conical compression spring having a small first end positioned against the first end of the valve plug chamber and a large second end positioned against the movable wall.

14. The improvement of claim 8, further comprising a pair of spaced apart stops, one on each side of the movable wall, between which the movable wall moves, said stops establishing the limits of movement of the movable wall and the valve plug.

15. The improvement of claim 14, wherein said spring is a compression spring positioned within the valve plug chamber, between the second end of the chamber and the valve plug.

16. The improvement of claim 14, wherein the spring is a compression spring positioned between the first end of the valve plug chamber and the movable wall.

17. The improvement of claim 16, wherein the spring is a conical compression spring having a small first end positioned against the first end of the valve plug chamber and a large second end positioned against the movable wall.

18. The improvement of claim 8, wherein the side of the movable wall opposite the connector rod is vented to atmosphere.

* * * * *